US012285835B2

(12) United States Patent
Akita et al.

(10) Patent No.: US 12,285,835 B2
(45) Date of Patent: Apr. 29, 2025

(54) HARD WAFER GRINDING METHOD

(71) Applicant: DISCO CORPORATION, Tokyo (JP)

(72) Inventors: Daisuke Akita, Tokyo (JP); Makoto Saito, Tokyo (JP); Takashi Yamaguchi, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 352 days.

(21) Appl. No.: 17/811,969

(22) Filed: Jul. 12, 2022

(65) Prior Publication Data

US 2023/0025120 A1 Jan. 26, 2023

(30) Foreign Application Priority Data

Jul. 26, 2021 (JP) ..... 2021-121411

(51) Int. Cl.

| | |
|---|---|
| ***B24B 1/00*** | (2006.01) |
| ***B24B 7/04*** | (2006.01) |
| ***B24B 41/00*** | (2006.01) |
| ***B24B 49/02*** | (2006.01) |

(52) U.S. Cl.

CPC ..... *B24B 1/00* (2013.01); *B24B 7/04* (2013.01); *B24B 41/002* (2013.01); *B24B 49/02* (2013.01)

(58) Field of Classification Search

CPC ..... B24B 1/00; B24B 7/04; B24B 41/002; B24B 49/02

USPC ..... 451/41

See application file for complete search history.

(56) References Cited

U.S. PATENT DOCUMENTS

2009/0186562 A1* 7/2009 Kajiyama ..... B24B 37/042 451/57
2012/0289126 A1* 11/2012 Tanikella ..... B24D 5/06 451/41
2020/0139503 A1* 5/2020 Kodama ..... B24B 7/228

FOREIGN PATENT DOCUMENTS

JP 2014180739 A 9/2014
JP 2015020250 A 2/2015
JP 2015160251 A * 9/2015

OTHER PUBLICATIONS

Machine Translation JP2015160251A (Year: 2015).*

* cited by examiner

*Primary Examiner* — Eric J Rosen
*Assistant Examiner* — Robert C Moore
(74) *Attorney, Agent, or Firm* — Greer, Burns & Crain, Ltd

(57) ABSTRACT

A hard wafer grinding method includes a rough grinding step of forming a section along the diameter of a hard wafer into a centrally recessed shape by roughly grinding the hard wafer such that a central part of the hard wafer is thinner than a peripheral part of the hard wafer, a finish grinding step of expanding a ground area of the hard wafer from the peripheral part in an annular shape to the central part while dressing lower surfaces of finish grinding stones by the peripheral part of the hard wafer of the centrally recessed shape after the rough grinding, then setting the whole of a radius part of the hard wafer as the ground area, and further finish-grinding the hard wafer so as to obtain a predetermined thickness.

9 Claims, 9 Drawing Sheets

HARD WAFER GRINDING METHOD

BACKGROUND OF THE INVENTION

Field of the Invention

The present invention relates to a hard wafer grinding method.

Description of the Related Art

When a sapphire wafer is ground by grinding stones, because the sapphire wafer is hard, the grinding stones may be dulled, and consequently it may be difficult to grind the sapphire wafer to a predetermined thickness.

This dulling does not occur at a time of rough grinding processing by rough grinding stones, but occurs at a time of finish grinding processing by finish grinding stones. This dulling is considered to occur at a time of an escape cut that separates, from the sapphire wafer, the finish grinding stones that have ground the sapphire wafer to a predetermined thickness.

Accordingly, Japanese Patent Laid-open No. 2015-020250, Japanese Patent Laid-open No. 2014-180739, and Japanese Patent Laid-open No. 2015-160251 disclose technologies for performing dressing of the grinding stones during grinding processing.

SUMMARY OF THE INVENTION

However, the technologies of Japanese Patent Laid-open No. 2015-020250, Japanese Patent Laid-open No. 2014-180739, and Japanese Patent Laid-open No. 2015-160251 increase amounts of wear of the grinding stones.

It is accordingly an object of the present invention to enable dressing of dulled grinding stones and grind a hard wafer such as a sapphire wafer or a silicon carbide (SiC) wafer to a predetermined thickness while reducing an amount of wear of the grinding stones when grinding the hard wafer.

In accordance with an aspect of the present invention, there is provided a hard wafer grinding method for grinding a radius part from a center to a periphery of a hard wafer held on a holding surface of a chuck table by lower surfaces of grinding stones arranged in an annular shape having a diameter larger than a radius of the hard wafer, the hard wafer grinding method including a rough grinding step of rotating the chuck table holding the hard wafer by the holding surface, bringing rough grinding stones arranged in an annular shape into contact with the radius part of the hard wafer, and forming a section along a diameter of the hard wafer into a centrally recessed shape by roughly grinding the hard wafer such that a central part of the hard wafer is thinner than a peripheral part of the hard wafer, and a finish grinding step of rotating the chuck table holding the hard wafer of the centrally recessed shape after the rough grinding by the holding surface, expanding a ground area of the hard wafer from the peripheral part in an annular shape to the central part while dressing, by the peripheral part of the hard wafer, lower surfaces of finish grinding stones capable of coming into contact with the radius part of the hard wafer and arranged in an annular shape by making the finish grinding stones approach the hard wafer from above the holding surface along a direction perpendicular to the holding surface, then setting a whole of the radius part of the hard wafer as the ground area, and further finish-grinding the hard wafer so as to obtain a predetermined thickness.

In accordance with another aspect of the present invention, there is provided a hard wafer grinding method for grinding a radius part from a center to a periphery of a hard wafer held on a holding surface of a chuck table by lower surfaces of grinding stones arranged in an annular shape having a diameter larger than a radius of the hard wafer, the hard wafer grinding method including a rough grinding step of rotating the chuck table holding the hard wafer by the holding surface, bringing rough grinding stones arranged in an annular shape into contact with the radius part of the hard wafer, and forming a section along a diameter of the hard wafer into a centrally projecting shape by roughly grinding the hard wafer such that a peripheral part of the hard wafer is thinner than a central part of the hard wafer, and a finish grinding step of rotating the chuck table holding the hard wafer of the centrally projecting shape after the rough grinding by the holding surface, expanding a ground area of the hard wafer from the central part to the peripheral part while dressing, by the central part of the hard wafer, lower surfaces of finish grinding stones capable of coming into contact with the radius part of the hard wafer and arranged in an annular shape by making the finish grinding stones approach the hard wafer from above the holding surface along a direction perpendicular to the holding surface, then setting a whole of the radius part of the hard wafer as the ground area, and further finish-grinding the hard wafer so as to obtain a predetermined thickness.

In accordance with a further aspect of the present invention, there is provided a hard wafer grinding method for grinding a radius part from a center to a periphery of a hard wafer held on a holding surface of a chuck table by lower surfaces of grinding stones arranged in an annular shape having a diameter larger than a radius of the hard wafer, the hard wafer grinding method including a rough grinding step of rotating the chuck table holding the hard wafer by the holding surface, bringing rough grinding stones arranged in an annular shape into contact with the radius part of the hard wafer, and forming a section along a diameter of the hard wafer into a W-shape by roughly grinding the hard wafer such that an intermediate part between a central part and a peripheral part of the hard wafer is thinnest, and a finish grinding step of rotating the chuck table holding the hard wafer of the W-shape after the rough grinding by the holding surface, expanding a ground area of the hard wafer from the central part toward the peripheral part and expanding the ground area of the hard wafer from the peripheral part toward the central part while dressing, by the central part and the peripheral part of the hard wafer, lower surfaces of finish grinding stones capable of coming into contact with the radius part of the hard wafer and arranged in an annular shape by making the finish grinding stones approach the hard wafer from above the holding surface along a direction perpendicular to the holding surface, then setting a whole of the radius part of the hard wafer as the ground area, and further finish-grinding the hard wafer so as to obtain a predetermined thickness.

In the grinding methods according to the respective aspects described above, it is preferable that grinding stones of a grain size of #1000 to #1400 be used as the rough grinding stones and that grinding stones of a grain size of #1800 to #2400 be used as the finish grinding stones.

In the grinding methods according to the respective aspects described above, the finish grinding step expands the ground area of the hard wafer (area of the ground area) while dressing the lower surfaces of the finish grinding stones by the peripheral part, the central part, or both the peripheral part and the central part of the hard wafer, and sets the whole (entire surface) of the radius part of the hard wafer as the ground area. Hence, even in a case where the finish grinding stones are dulled, the finish grinding stones can be dressed excellently by the peripheral part and/or the central part of the hard wafer at the beginning of the finish grinding of the hard wafer, so that the dulling can be resolved. Consequently, it becomes easy to grind the hard wafer to a predetermined thickness.

In addition, when the hard wafer is ground, additional dressing of the finish grinding stones does not need to be performed. It is therefore possible to suppress unnecessary wear in the finish grinding stones. Further, no dressing apparatus needs to be used, and therefore cost involved in grinding the hard wafer can be reduced.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
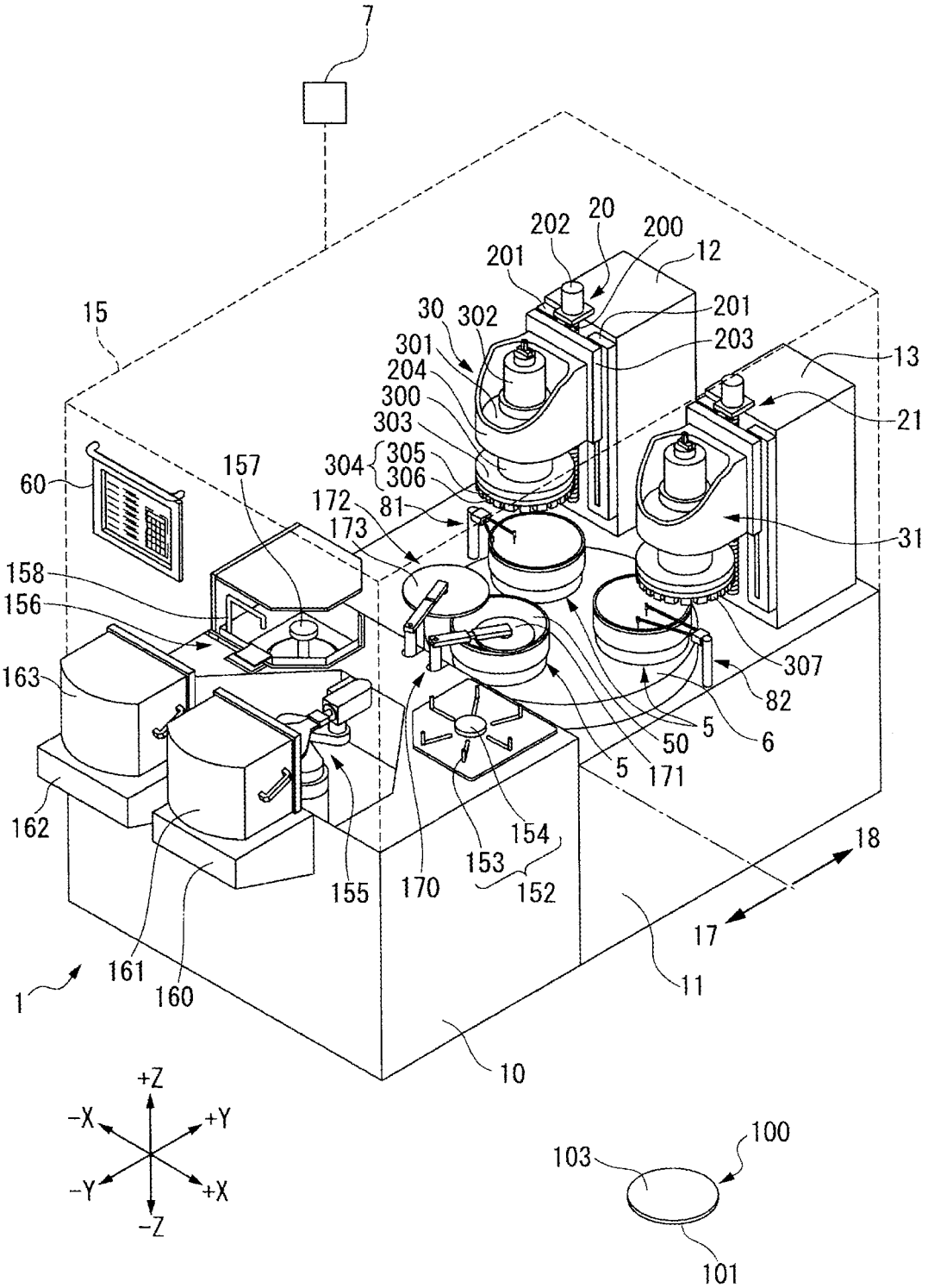
FIG. 1 is a perspective view illustrating a configuration of a grinding apparatus.

An embodiment of the present invention will hereinafter be described with reference to the accompanying drawings. Incidentally, in the accompanying drawings, sections may not be hatched for the convenience of description. A grinding apparatus 1 illustrated in FIG. 1 includes a rough grinding mechanism 30 and a finish grinding mechanism 31. The grinding apparatus 1 grinds a wafer 100 held on a chuck table 5 by the rough grinding mechanism 30 and the finish grinding mechanism 31.

The wafer 100 illustrated in FIG. 1 is a hard wafer, and is, for example, a sapphire wafer or a SiC wafer in a circular shape. Devices not illustrated are formed on a front surface 101 of the wafer 100. The front surface 101 of the wafer 100 in FIG. 1 is oriented downward, and is protected by affixing thereto a protective tape not illustrated. An back surface 103 of the wafer 100 is a processing target surface to be subjected to grinding processing.

The grinding apparatus 1 includes a first apparatus base 10 and a second apparatus base 11 disposed in the rear (+Y direction side) of the first apparatus base 10. A loading and unloading region 17 as a region where loading and unloading of the wafer 100 and the like are performed is formed on the first apparatus base 10. A processing region 18 is formed on the second apparatus base 11. In this processing region 18, the rough grinding mechanism 30 and the finish grinding mechanism 31 process the wafer 100 held on the chuck table 5.

A first cassette stage 160 and a second cassette stage 162 are provided on the front side (−Y direction side) of the first apparatus base 10. A first cassette 161 housing wafers 100 before being processed is mounted on the first cassette stage 160. A second cassette 163 housing wafers 100 after being processed is mounted on the second cassette stage 162.

The first cassette 161 and the second cassette 163 internally have a plurality of shelves. Each shelf houses one wafer 100. That is, the first cassette 161 and the second cassette 163 house a plurality of wafers 100 in a shelf manner.

Openings (not illustrated) of the first cassette 161 and the second cassette 163 face the +Y direction side. A robot 155 is disposed on the +Y direction side of these openings. The robot 155 has a holding surface that holds a wafer 100. The robot 155 loads (houses) a wafer 100 after being processed into the second cassette 163. In addition, the robot 155 extracts a wafer 100 before being processed from the first cassette 161, and mounts the wafer 100 on a temporary placement table 154 of a temporary placement mechanism 152.

The temporary placement mechanism 152 is used for temporarily placing the wafer 100 extracted from the first cassette 161. The temporary placement mechanism 152 is provided at a position adjacent to the robot 155. The temporary placement mechanism 152 includes the temporary placement table 154 and a positioning member 153. The positioning member 153 includes a plurality of positioning pins arranged on the outside of the temporary placement table 154 so as to surround the temporary placement table 154 and sliders that move the positioning pins in the radial direction of the temporary placement table 154. The positioning member 153 reduces the diameter of a circle connecting the plurality of positioning pins to one another by moving the positioning pins toward a center in the radial direction of the temporary placement table 154. The wafer 100 mounted on the temporary placement table 154 with the back surface 103 oriented upward is thereby positioned at a predetermined position (centered).

A loading mechanism 170 is provided at a position adjacent to the temporary placement mechanism 152. The loading mechanism 170 loads the wafer 100 temporarily placed on the temporary placement mechanism 152 onto a chuck table 5. The loading mechanism 170 includes a transporting pad 171 having a suction surface that sucks and holds the back surface 103 of the wafer 100. The loading mechanism 170 sucks and holds the wafer 100 temporarily placed on the temporary placement table 154 by the transporting pad 171, transports the wafer 100 to a chuck table 5 located in the vicinity of the temporary placement mechanism 152 and in the processing region 18, and mounts the wafer 100 onto a holding surface 50 of the chuck table 5.

The chuck table 5 is an example of a holding member that holds the wafer 100. The chuck table 5 has the holding surface 50 that sucks and holds the wafer 100. The holding surface 50 is made to communicate with a suction source (not illustrated), and can therefore suck and hold the wafer 100 via the protective tape. The chuck table 5 is rotatable about a table rotational axis 501 (see FIG. 2) as a central axis passing through the center of the holding surface 50 and extending in a Z-axis direction in a state in which the chuck table 5 sucks and holds the wafer 100 by the holding surface 50.

In the present embodiment, on the upper surface of a turn table 6 disposed on the second apparatus base 11, three chuck tables 5 are arranged at equal intervals on a circle centered at the center of the turn table 6. A rotary shaft not illustrated for rotation of the turn table 6 is disposed at the center of the turn table 6. The turn table 6 can rotate by the rotary shaft about an axis extending in the Z-axis direction. When the turn table 6 rotates, the three chuck tables 5 revolve. The chuck tables 5 can be thereby sequentially positioned in the vicinity of the temporary placement mechanism 152, below the rough grinding mechanism 30, and below the finish grinding mechanism 31.

A first column 12 is erected in the rear (+Y direction side) on the second apparatus base 11. Arranged on the front surface of the first column 12 are a rough grinding mechanism 30 that roughly grinds the wafer 100 and a rough grinding feed mechanism 20 that grinding-feeds the rough grinding mechanism 30.

The rough grinding feed mechanism 20 includes a pair of guide rails 201 parallel with the Z-axis direction, a raising and lowering table 203 that slides on the guide rails 201, a ball screw 200 parallel with the guide rails 201, a motor 202 that rotationally drives the ball screw 200, and a holder 204 attached to the raising and lowering table 203. The holder 204 holds the rough grinding mechanism 30.

The raising and lowering table 203 is slidably installed on the guide rails 201. A nut portion not illustrated is fixed to the raising and lowering table 203. The ball screw 200 is screwed in the nut portion. The motor 202 is connected to one end portion of the ball screw 200.

In the rough grinding feed mechanism 20, the motor 202 rotates the ball screw 200, and thereby the raising and lowering table 203 moves in the Z-axis direction along the guide rails 201. The holder 204 attached to the raising and lowering table 203 and the rough grinding mechanism 30 held by the holder 204 thereby also move in the Z-axis direction together with the raising and lowering table 203. The rough grinding feed mechanism 20 thus grinding-feeds the rough grinding mechanism 30 along the Z-axis direction.

The rough grinding mechanism 30 includes a spindle housing 301 fixed to the holder 204, a spindle 300 rotatably held by the spindle housing 301, a motor 302 that rotationally drives the spindle 300, a wheel mount 303 attached to a lower end of the spindle 300, and a grinding wheel 304 detachably connected to the lower surface of the wheel mount 303.

The spindle housing 301 is held by the holder 204 so as to extend in the Z-axis direction. The spindle 300 extends in the Z-axis direction so as to be orthogonal to the holding surface 50 of the chuck table 5, and is rotatably supported by the spindle housing 301.

The motor 302 is connected to an upper end side of the spindle 300. The motor 302 rotates the spindle 300 about a spindle rotational axis 505 (see FIG. 2) extending in the Z-axis direction.

The wheel mount 303 is formed in a disk shape. The wheel mount 303 is fixed to the lower end of the spindle 300, and rotates according to the rotation of the spindle 300. The wheel mount 303 supports the grinding wheel 304.

The grinding wheel 304 is formed such that the grinding wheel 304 has substantially the same outside diameter as the outside diameter of the wheel mount 303. The grinding wheel 304 includes an annular wheel base (annular base) 305 formed of a metallic material such as an aluminum alloy. A plurality of rough grinding stones 306 are fixed to the lower surface of the wheel base 305 over the entire circumference of the lower surface. The rough grinding stones 306 are arranged in an annular shape having a diameter larger than the radius of the wafer 100, and can come into contact with a radius part of the wafer 100 held on the holding surface 50 of the chuck table 5.

The rough grinding stones 306 are rotated by the motor 302 via the spindle 300, the wheel mount 303, and the wheel base 305 about the spindle rotational axis 505 (see FIG. 2) passing through the center of the rough grinding stones 306 and extending in the Z-axis direction such that the rough grinding stones 306 pass the center of the holding surface 50 of the chuck table 5 (that is, the center of the wafer 100 held on the holding surface 50). The rough grinding stones 306 grind, by lower surfaces thereof, the radius part from the center to the outer circumference of the wafer 100 held on the chuck table 5. The rough grinding stones 306 are grindstones including relatively large abrasive grains, and are, for example, grinding stones of a grain size of #1000 to #1400.

A grinding water flow passage extending in the Z-axis direction is formed in the spindle 300. A grinding water supply mechanism not illustrated communicates with the grinding water flow passage (neither of the grinding water supply mechanism and the grinding water flow passage is illustrated). Grinding water supplied from the grinding water supply mechanism to the spindle 300 is jetted downward from an opening at a lower end of the grinding water flow passage to the rough grinding stones 306, and reaches a contact region between the rough grinding stones 306 and the wafer 100.

A first height gauge 81 is disposed at a position adjacent to the chuck table 5 disposed below the rough grinding mechanism 30. The first height gauge 81 measures the thickness of the wafer 100 in a contact manner or a non-contact manner during rough grinding, for example.

In addition, a second column 13 is erected in the rear on the second apparatus base 11 so as to be adjacent to the first column 12 along an X-axis direction. Arranged on the front surface of the second column 13 are a finish grinding mechanism 31 that finish-grinds the wafer 100 and a finish grinding feed mechanism 21 that grinding-feeds the finish grinding mechanism 31.

The finish grinding feed mechanism 21 has a similar configuration to that of the rough grinding feed mechanism 20. The finish grinding feed mechanism 21 can grinding-feed the finish grinding mechanism 31 along the Z-axis direction. The finish grinding mechanism 31 has a similar configuration to that of the rough grinding mechanism 30 except that the finish grinding mechanism 31 includes a plurality of finish grinding stones 307 in place of the plurality of rough grinding stones 306. As with the rough grinding stones 306, the finish grinding stones 307 are arranged in an annular shape having a diameter larger than the radius of the wafer 100, and can come into contact with the radius part of the wafer 100 held on the holding surface 50 of the chuck table 5.

The finish grinding stones 307 are also rotated by the motor 302 via the spindle 300, the wheel mount 303, and the wheel base 305 about the spindle rotational axis 505 (see FIG. 2) passing through the center of the finish grinding stones 307 and extending in the Z-axis direction such that the finish grinding stones 307 pass the center of the holding surface 50 of the chuck table 5. The finish grinding stones 307 grind, by lower surfaces thereof, the radius part of the wafer 100 held on the chuck table 5. The finish grinding stones 307 are grindstones including relatively small abrasive grains, and are, for example, grinding stones of a grain size of #1800 to #2400.

A second height gauge 82 is disposed at a position adjacent to the chuck table 5 disposed below the finish grinding mechanism 31. The second height gauge 82 measures the thickness of the wafer 100 in a contact manner or a noncontact manner during finish grinding, for example.

The wafer 100 after being finish-ground is unloaded by an unloading mechanism 172. The unloading mechanism 172 transports the wafer 100 held on the chuck table 5 to a spinner cleaning mechanism 156.

The unloading mechanism 172 includes a transporting pad 173 having a suction surface that sucks and holds the back surface 103 of the wafer 100. The unloading mechanism 172 sucks and holds, by the transporting pad 173, the back surface 103 of the wafer 100 after being finish-ground which is mounted on the chuck table 5. Thereafter, the unloading mechanism 172 unloads the wafer 100 from the chuck table 5, and transports the wafer 100 to a spinner table 157 of the single wafer spinner cleaning mechanism 156.

The spinner cleaning mechanism 156 is a spinner cleaning unit that cleans the wafer 100. The spinner cleaning mechanism 156 includes the spinner table 157 that holds the wafer 100 and a nozzle 158 that jets cleaning water and drying air to the spinner table 157.

In the spinner cleaning mechanism 156, the spinner table 157 holding the wafer 100 rotates, and cleaning water is jetted to the back surface 103 of the wafer 100, so that the back surface 103 is spinner-cleaned. The wafer 100 is thereafter dried by blowing drying air onto the wafer 100.

The robot 155 loads the wafer 100 cleaned by the spinner cleaning mechanism 156 into the second cassette 163 on the second cassette stage 162.

In addition, the grinding apparatus 1 includes a casing 15 that covers the first apparatus base 10 and the second apparatus base 11. A touch panel 60 is installed on a side surface of the casing 15.

The touch panel 60 displays various kinds of information such as device data (processing conditions) related to the grinding apparatus 1. In addition, the touch panel 60 is used also to input various kinds of information such as the device data. Thus, the touch panel 60 functions as a display member for displaying information, and functions also as an input member for inputting information.

In addition, the grinding apparatus 1 includes therein a control unit 7 for control of the grinding apparatus 1. The control unit 7 includes a central processing unit (CPU) that performs arithmetic processing according to a control program as well as a storage medium such as a memory, and the like. The control unit 7 performs various kinds of processing, and performs centralized control of constituent elements of the grinding apparatus 1.

Figure 2:
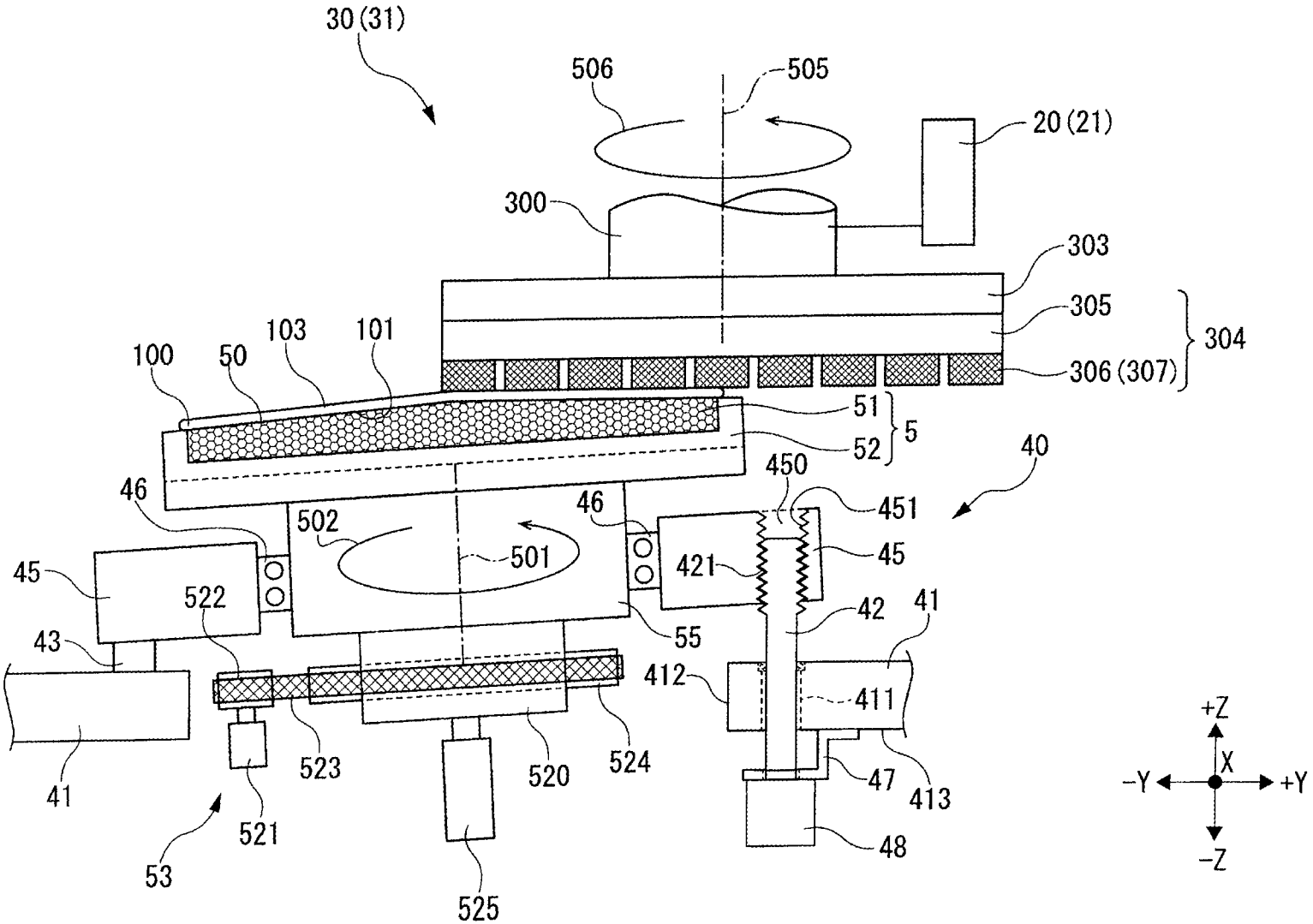
FIG. 2 is a diagram illustrating a configuration of a chuck table and vicinities thereof.

Here, a configuration of the chuck table 5 and vicinities thereof will be described in detail. As illustrated in FIG. 2, the chuck table 5 is a table in substantially a disk shape for holding the wafer 100, and the chuck table 5 includes a porous member 51 in substantially a disk shape and a frame body 52 that supports the porous member 51.

The upper surface of the porous member 51 is the above-described holding surface 50 for holding the wafer 100. The holding surface 50 is formed as a conical surface having a center thereof as a vertex. When a suction force from the suction source (not illustrated) is transmitted to the holding surface 50, the chuck table 5 can suck and hold the wafer 100 by the holding surface 50.

In addition, the chuck table 5 can be rotated by a table rotating mechanism 53. Specifically, a cylindrical table base 55 that supports the chuck table 5 is provided under the chuck table 5. The table rotating mechanism 53 that rotatably supports the table base 55 is disposed under the table base 55.

The table rotating mechanism 53 is, for example, a pulley mechanism. The table rotating mechanism 53 includes a motor 521 serving as a driving source, a driving pulley 522 attached to a shaft of the motor 521, a driven pulley 524 connected to the driving pulley 522 via an endless belt 523, a rotating body 520 that supports the driven pulley 524, and a rotary joint 525 disposed under the rotating body 520. The rotary joint 525 is used to connect the suction source and the holding surface 50 to each other. The rotating body 520 is connected directly below the center of the holding surface 50 to the lower surface of the table base 55, and extends perpendicularly to the lower surface of the table base 55.

In the table rotating mechanism 53, when the motor 521 rotationally drives the driving pulley 522, the endless belt 523 rotates with the rotation of the driving pulley 522. The driven pulley 524 and the rotating body 520 rotate when the endless belt 523 rotates. The table base 55 and the chuck table 5 are thereby rotated as indicated by an arrow 502 about the table rotational axis 501, which is the central axis of the holding surface 50.

In addition, provided on the periphery of the table base 55 is an inclination adjusting mechanism 40 that adjusts a relative inclination between the lower surfaces of the rough grinding stones 306 or the finish grinding stones 307 and the holding surface 50. In the present embodiment, the inclination adjusting mechanism 40 is configured to adjust the inclination of the holding surface 50 with respect to the lower surfaces of the rough grinding stones 306 or the finish grinding stones 307 by adjusting the inclination of the chuck table 5.

The inclination adjusting mechanism 40 includes an internal base 41 disposed below the chuck table 5 and having an opening portion 412 surrounding the table rotating mechanism 53, an inclination adjusting shaft 42 that penetrates the internal base 41, a fixed shaft 43 fixed to the internal base 41, and an annular member 45.

The annular member 45 rotatably supports the table base 55 via a connecting portion 46 including bearings so as to surround the table base 55.

The fixed shaft 43 has an upper end thereof fixed to the lower surface of the annular member 45, and has a lower end thereof fixed to the upper surface of the internal base 41.

The inclination adjusting shaft 42 is provided so as to penetrate a through hole 411 formed in the internal base 41 and extending in the Z-axis direction. In addition, a male thread 421 is formed on the upper end side of the inclination adjusting shaft 42.

In addition, a through hole 450 is formed in a part of the annular member 45 which corresponds to the inclination adjusting shaft 42. A female thread 451 having a shape corresponding to the male thread 421 of the inclination adjusting shaft 42 is formed in the through hole 450. The inclination adjusting shaft 42 is inserted into the through hole 450. The inclination adjusting shaft 42 supports the annular member 45 in a state in which the male thread 421 of the inclination adjusting shaft 42 is screwed in the female thread 451 of the annular member 45.

The inclination adjusting mechanism 40 further includes a driving unit 48 that rotationally drives the inclination adjusting shaft 42, and a fixing member 47 that fixes the driving unit 48 to a lower surface 413 of the internal base 41. When the driving unit 48 rotationally drives the inclination adjusting shaft 42, a formation part of the through hole 450 (part on the +Y direction side in FIG. 2) in the annular member 45, in which the inclination adjusting shaft 42 is inserted, vertically moves along the Z-axis direction. Consequently, part on the +Y direction side of the table base 55 supported by the annular member 45 and part on the +Y direction side of the chuck table 5 supported by the table base 55 also vertically move along the Z-axis direction. The inclination of the holding surface 50 of the chuck table 5 is thereby adjusted.

Incidentally, in the present embodiment, the inclination adjusting mechanism 40 is provided with two inclination adjusting shafts 42 (one is not illustrated), and the inclination of the holding surface 50 of the chuck table 5 is adjusted by rotationally driving one or both of the inclination adjusting shafts 42. Incidentally, the two inclination adjusting shafts 42 and the fixed shaft 43 are, for example, provided to the internal base 41 at intervals of 120 degrees around the center of the holding surface 50.

Thus, in the present embodiment, the chuck table 5 is adjusted in inclination by the inclination adjusting mechanism 40, and is rotated about the table rotational axis 501 by the table rotating mechanism 53. Then, the radius part of the wafer 100 held on the holding surface 50 of the chuck table 5 is ground by the rough grinding stones 306 or the finish grinding stones 307 that are arranged so as to pass the center of the wafer 100 and rotate about the spindle rotational axis 505 as indicated by an arrow 506.

A wafer grinding method in the grinding apparatus 1 under control of the control unit 7 will next be described in more detail. This grinding method is a hard wafer grinding method that grinds the radius part of the wafer 100 as a hard wafer held on the holding surface 50 of the chuck table 5 by the lower surfaces of the rough grinding stones 306 and the finish grinding stones 307 arranged in an annular shape having a diameter larger than the radius of the wafer 100.

(1) Holding Step

First, the control unit 7 controls the robot 155 illustrated in FIG. 1 to extract a wafer 100 before being processed from the first cassette 161, mount the wafer 100 onto the temporary placement table 154 of the temporary placement mechanism 152, and perform positioning of the wafer 100. Further, the control unit 7 controls the loading mechanism 170 to hold the wafer 100 on the temporary placement table 154, and mount the wafer 100 onto the holding surface 50 of a chuck table 5 disposed in the vicinity of the temporary placement mechanism 152 with the back surface 103 as an upper surface. The control unit 7 thereafter makes the holding surface 50 communicate with the suction source not illustrated. As illustrated in FIG. 2, the holding surface 50 thereby sucks and holds the wafer 100. The chuck table 5 thus holds the wafer 100 by the holding surface 50.

(2) Rough Grinding Step

This step rotates the chuck table 5 holding the wafer 100 by the holding surface 50, brings the rough grinding stones 306 into contact with the radius part of the wafer 100, and forms a section along the diameter of the wafer 100 into a centrally recessed shape by roughly grinding the wafer 100 such that a central part of the wafer 100 is thinner than a peripheral portion of the wafer 100.

Specifically, after the holding step, the control unit 7 disposes the chuck table 5 holding the wafer 100 below the rough grinding mechanism 30 by rotating the turn table 6 illustrated in FIG. 1.

Figure 3:
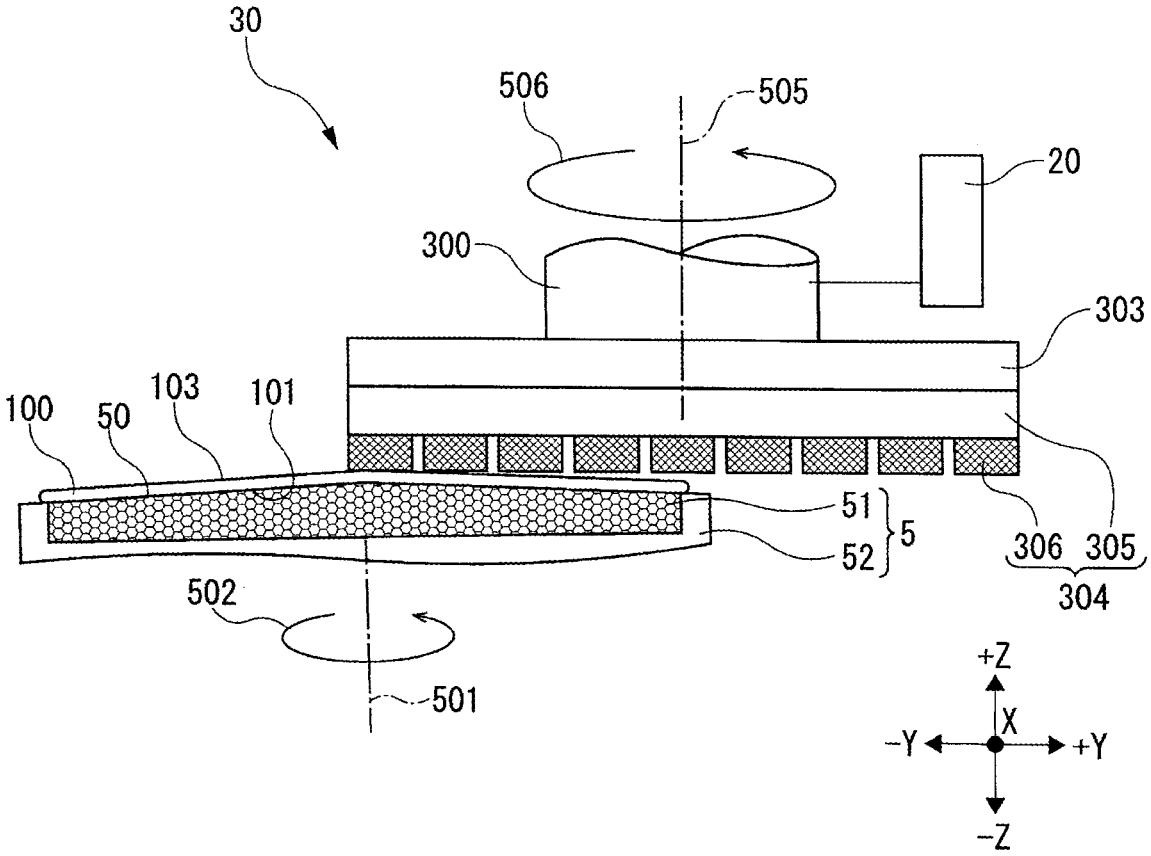
FIG. 3 is a diagram illustrating the inclination of the chuck table when a centrally recessed shape wafer is formed.

At this time, the control unit 7 controls the inclination adjusting mechanism 40 to adjust the inclination of the chuck table 5, and thereby adjusts the inclination of the holding surface 50 with respect to the lower surfaces of the rough grinding stones 306 such that the central side of the wafer 100 comes into contact with the rough grinding stones 306 before the peripheral side of the wafer 100, as illustrated in FIG. 3, for example.

Next, the control unit 7 rotationally drives the spindle 300 about the spindle rotational axis 505, as indicated by the arrow 506, by using the motor 302 (see FIG. 1) of the rough grinding mechanism 30. The rough grinding stones 306 attached to the lower end of the spindle 300 are thereby rotated. In this state, the control unit 7 lowers the rough grinding mechanism 30 along the Z-axis direction by the rough grinding feed mechanism 20. Further, the control unit 7 rotates the chuck table 5 about the table rotational axis 501 as indicated by an arrow 502 by the table rotating mechanism 53 (see FIG. 2). Consequently, the rotating rough grinding stones 306 come into contact with the back surface 103 of the wafer 100 held on the rotating chuck table 5, and roughly grind the back surface 103.

Figure 4:
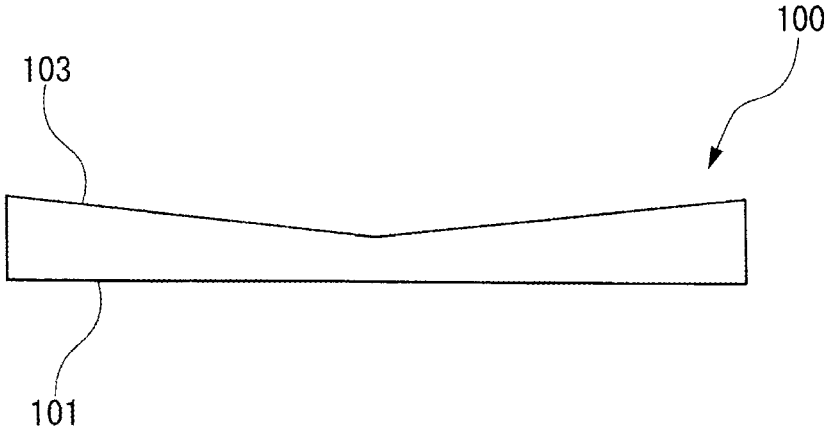
FIG. 4 is a diagram illustrating the centrally recessed shape wafer.

In this grinding, as illustrated in FIG. 3, the central side of the wafer 100 comes into contact with the rough grinding stones 306 before the peripheral side of the wafer 100. Therefore, the grinding is started with the central part, and the back surface 103 of the wafer 100 is ground such that a ground region gradually expands to the peripheral side. As a result, as illustrated in FIG. 4, the wafer 100 is ground such that a central part of the back surface 103 as a ground surface is recessed and the section along the diameter of the wafer 100 becomes a centrally recessed shape. The wafer 100 thus becomes a centrally recessed shape wafer 100.

Incidentally, the control unit 7 measures, for example, the thickness of the central part of the wafer 100 by using the first height gauge 81 in the rough grinding step, and performs the rough grinding until this thickness becomes a predetermined thickness. Incidentally, the measurement position of the first height gauge 81 is preferably set so as to measure a thinnest part of the wafer 100.

(3) Finish Grinding Step

In this step, the control unit 7 first disposes the chuck table 5 holding the centrally recessed shape wafer 100 after being roughly ground by the holding surface 50 below the finish grinding mechanism 31 by rotating the turn table 6 illustrated in FIG. 1. Consequently, as illustrated in FIG. 5, the centrally recessed shape wafer 100 is disposed below the finish grinding stones 307 in the finish grinding mechanism 31.

Next, the control unit 7 rotationally drives the spindle 300 about the spindle rotational axis 505, as indicated by the arrow 506, by driving the motor 302 (see FIG. 1) of the finish grinding mechanism 31. The finish grinding stones 307 attached to the lower end of the spindle 300 are thereby rotated. Further, the control unit 7 rotates the chuck table 5 by the table rotating mechanism 53 (see FIG. 2). Consequently, as illustrated in FIG. 5, the wafer 100 is rotated about the table rotational axis 501 as indicated by the arrow 502.

In this state, the control unit 7 lowers the finish grinding mechanism 31 along the Z-axis direction by the finish grinding feed mechanism 21. Thus, the control unit 7 lowers the rotating finish grinding stones 307 from above the holding surface 50 along a direction perpendicular to the holding surface 50, and thereby makes the rotating finish grinding stones 307 approach the wafer 100. Then, the control unit 7 brings the finish grinding stones 307 into contact with the back surface 103 of the wafer 100 held on the rotating chuck table 5, and thereby finish-grinds the back surface 103. Incidentally, FIG. 5 illustrates a finished thickness T1 as a thickness of the wafer 100 after the finish grinding step.

Figure 5:
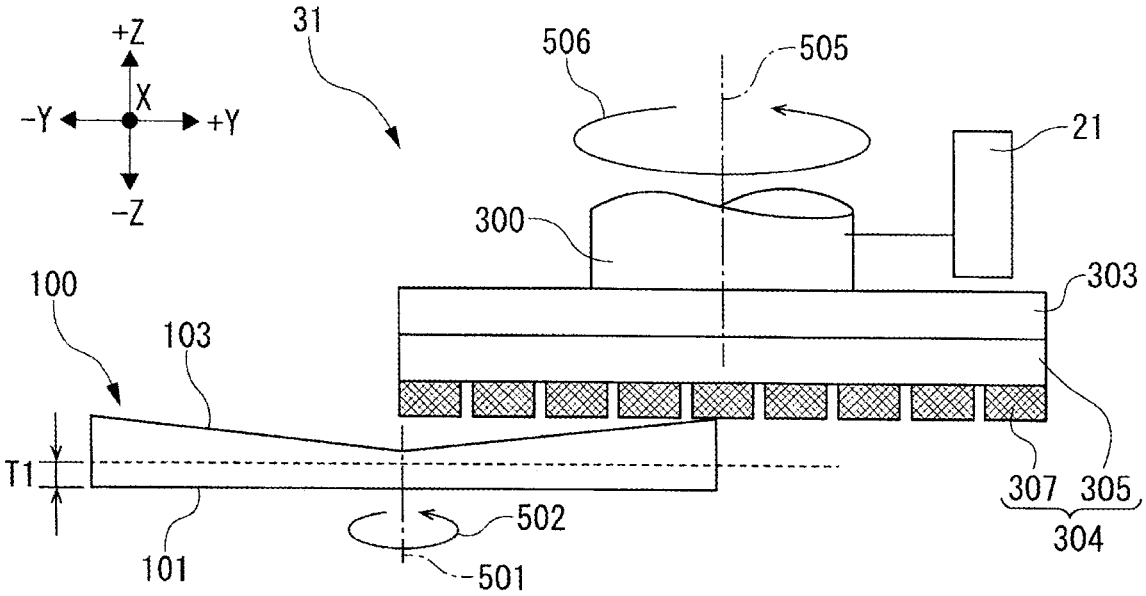
FIG. 5 is a diagram illustrating a finish grinding step for the centrally recessed shape wafer.

In this grinding, because the wafer 100 has a centrally recessed shape, as illustrated in FIG. 5, the finish grinding stones 307 first come into contact with a peripheral part of the wafer 100, and grind the peripheral part of the wafer 100. The peripheral part of the wafer 100 thereby dresses the lower surfaces of the finish grinding stones 307.

Figure 6:
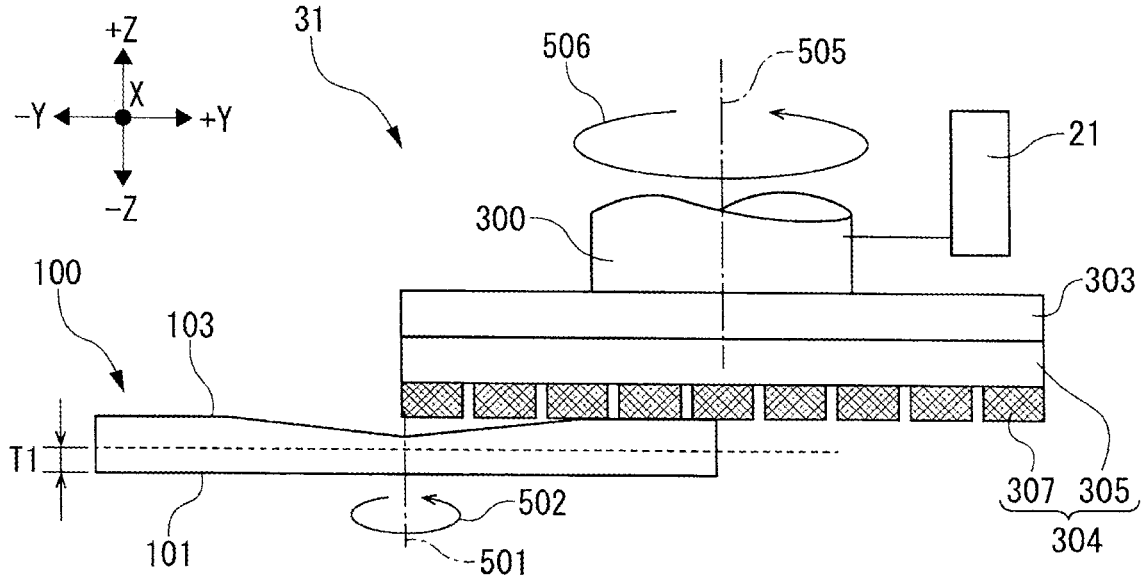
FIG. 6 is a diagram illustrating the finish grinding step for the centrally recessed shape wafer.

Thereafter, as the finish grinding mechanism 31 is lowered by the finish grinding feed mechanism 21, as illustrated in FIG. 6, the ground area of the wafer 100 (area of the ground area) expands from the annular peripheral part to the central part. The whole of the radius part of the wafer 100 (the whole of the back surface 103) thus becomes the ground area.

Figure 7:
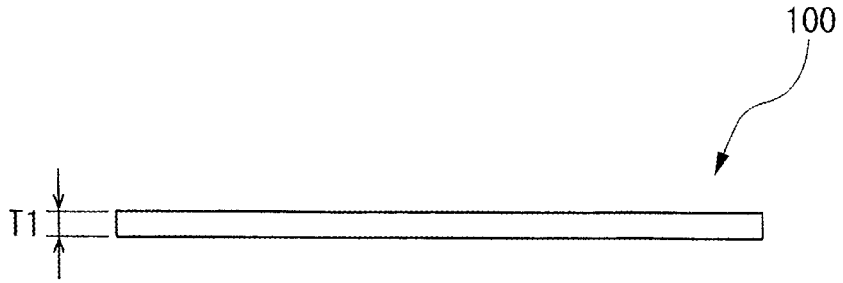
FIG. 7 is a diagram illustrating the wafer after finish grinding.

In addition, at a time of the finish grinding, the control unit 7 measures the thickness of the wafer 100 by using the second height gauge 82. The control unit 7 performs the finish grinding until the thickness of the wafer 100 becomes the predetermined finished thickness T1. Consequently, as illustrated in FIG. 7, the wafer 100 having a uniform finished thickness T1 is obtained.

As described above, in the finish grinding step in the present embodiment, the ground area of the wafer 100 is expanded from the annular peripheral part to the central part while the peripheral part of the wafer 100 dresses the lower surfaces of the finish grinding stones 307. Then, the whole of the radius part of the wafer 100 (the whole of the back surface 103) is set as the ground area, and further the wafer 100 is finish-ground so as to have the predetermined finished thickness T1.

Hence, in the present embodiment, even in a case where the finish grinding stones 307 are dulled when the wafer 100 as a hard wafer such as a sapphire wafer or a SiC wafer is to be finish-ground, the finish grinding stones 307 can be dressed excellently by the peripheral part of the hard wafer 100 at the beginning of the finish grinding of the wafer 100, so that the dulling can be resolved. Consequently, it becomes easy to grind the wafer 100 to a predetermined thickness.

In addition, when the wafer 100 as a hard wafer is ground, additional dressing of the finish grinding stones 307 does not need to be performed. It is therefore possible to suppress unnecessary wear in the finish grinding stones 307. Further, no dressing apparatus needs to be used, and therefore cost involved in grinding the wafer 100 can be reduced.

Figure 8:
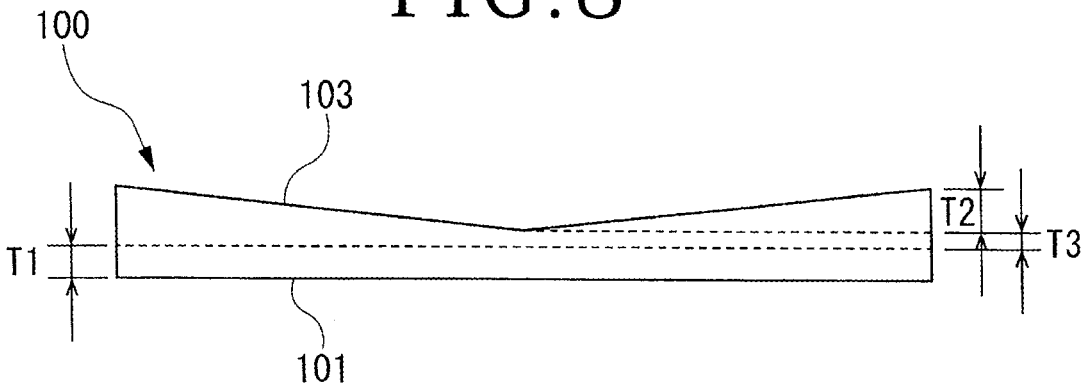
FIG. 8 is a diagram illustrating the centrally recessed shape wafer.

Incidentally, in the finish grinding step in the present embodiment, the centrally recessed shape wafer 100 as illustrated in FIG. 4 and FIG. 8 is finish-ground so as to have the predetermined finished thickness T1. In this case, as illustrated in FIG. 8, until the ground area of the wafer 100 reaches the central part, that is, until the ground thickness of the wafer 100 becomes a thickness T2, the finish grinding stones 307 are dressed by the peripheral part of the hard wafer 100. Thus, a high setting effect on the finish grinding stones 307 can be obtained.

On the other hand, until the thickness of the wafer 100 becomes the finished thickness T1 after the ground area of the wafer 100 reaches the central part, that is, until the ground thickness becomes a thickness T3 after the ground area reaches the central part, the entire surface of the wafer 100 is the ground area. Thus, the setting effect on the finish grinding stones 307 is decreased.

In addition, in the above-described rough grinding step, the control unit 7 forms the centrally recessed shape wafer 100 such that the back surface 103 of the wafer 100 has a substantially uniform slope from the periphery to the center, as illustrated in FIG. 4 and FIG. 8.

Figure 9:
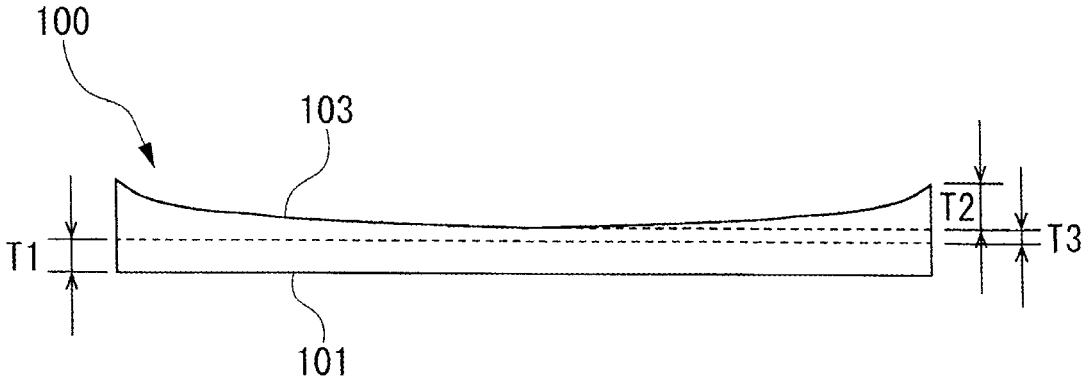
FIG. 9 is a diagram illustrating a centrally recessed shape wafer.

In relation to this, in the rough grinding step, by adjusting the inclination of the chuck table 5 by the inclination adjusting mechanism 40, the control unit 7 may form a centrally recessed shape wafer 100 such that the back surface 103 of the wafer 100 has a downwardly projecting slope from the periphery to the center, as illustrated in FIG. 9. Also in this case, until the ground area of the wafer 100 reaches the central part (until the ground thickness becomes the thickness T2), a high setting effect on the finish grinding stones 307 can be obtained. On the other hand, until the thickness of the wafer 100 becomes the finished thickness T1 (until the ground thickness becomes the thickness T3) after the ground area reaches the central part, the setting effect on the finish grinding stones 307 is decreased.

In addition, in the rough grinding step, the control unit 7 may rotate the chuck table 5 holding the wafer 100 by the holding surface 50, bring the rough grinding stones 306 into contact with the radius part of the wafer 100, and form the section along the diameter of the wafer 100 into a centrally projecting shape by roughly grinding the wafer 100 such that the peripheral part is thinner than the central part.

Figure 10:
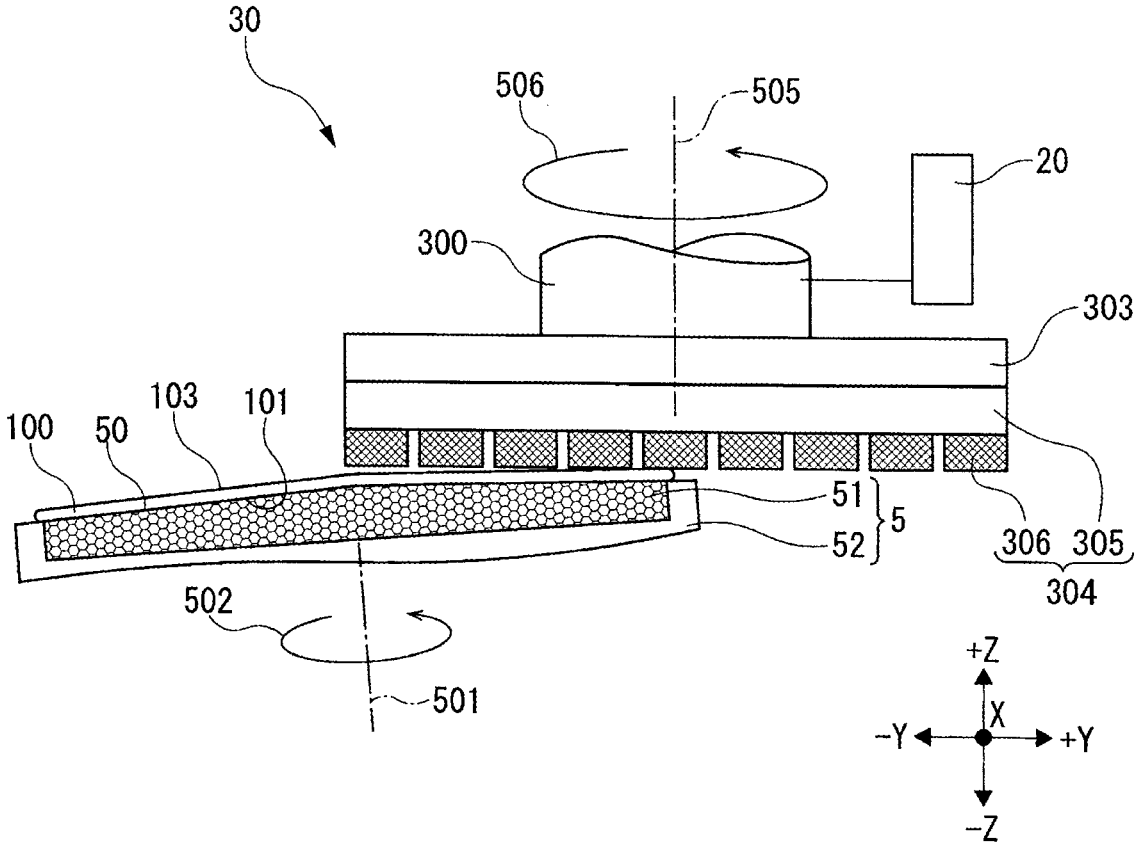
FIG. 10 is a diagram illustrating the inclination of the chuck table when a centrally projecting shape wafer is formed.

Specifically, when the control unit 7 disposes the chuck table 5 holding the wafer 100 below the rough grinding mechanism 30 after the holding step, the control unit 7 controls the inclination adjusting mechanism 40 to adjust the inclination of the chuck table 5, and thereby adjusts the inclination of the holding surface 50 with respect to the lower surfaces of the rough grinding stones 306 such that the peripheral side of the wafer 100 comes into contact with the rough grinding stones 306 before the central side of the wafer 100, as illustrated in FIG. 10.

Next, the control unit 7 rotationally drives the spindle 300 about the spindle rotational axis 505, as indicated by the arrow 506, by using the motor 302 (see FIG. 1) of the rough grinding mechanism 30. The rough grinding stones 306 attached to the lower end of the spindle 300 are thereby rotated. In this state, the control unit 7 lowers the rough grinding mechanism 30 along the Z-axis direction by the rough grinding feed mechanism 20. Further, the control unit 7 rotates the chuck table 5 about the table rotational axis 501 as indicated by the arrow 502 by the table rotating mechanism 53 (see FIG. 2). Consequently, the rotating rough grinding stones 306 come into contact with the back surface 103 of the wafer 100 held on the rotating chuck table 5, and roughly grind the back surface 103.

Figure 11:
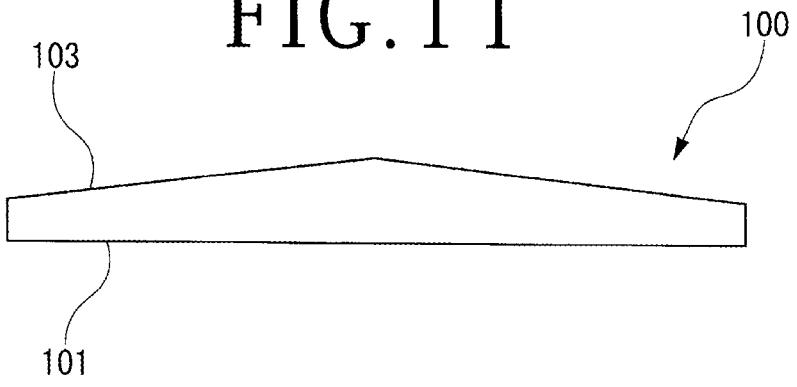
FIG. 11 is a diagram illustrating the centrally projecting shape wafer.

In this grinding, as illustrated in FIG. 10, the peripheral side of the wafer 100 comes into contact with the rough grinding stones 306 before the central side of the wafer 100. Therefore, the grinding is started with the peripheral part, and the back surface 103 of the wafer 100 is ground such that the ground region gradually expands to the central side. As a result, as illustrated in FIG. 11, the wafer 100 is ground such that a central part of the back surface 103 as a ground surface is raised and the section along the diameter of the wafer 100 becomes a centrally projecting shape. The wafer 100 thus becomes a centrally projecting shape wafer 100.

Incidentally, the control unit 7 measures, for example, the thickness of the peripheral part of the wafer 100 by using the first height gauge 81 in the rough grinding step, and performs the rough grinding until this thickness becomes a predetermined thickness. Incidentally, the measurement position of the first height gauge 81 is preferably set so as to measure a thinnest part of the wafer 100.

In addition, in the finish grinding step for the centrally projecting shape wafer 100, the control unit 7 first disposes the chuck table 5 holding the centrally projecting shape wafer 100 after being roughly ground by the holding surface 50 below the finish grinding mechanism 31 by rotating the turn table 6 illustrated in FIG. 1. Consequently, as illustrated in FIG. 12, the centrally projecting shape wafer 100 is disposed below the finish grinding stones 307 in the finish grinding mechanism 31.

Next, the control unit 7 rotationally drives the spindle 300 about the spindle rotational axis 505, as indicated by the arrow 506, by driving the motor 302 (see FIG. 1) of the finish grinding mechanism 31. The finish grinding stones 307 attached to the lower end of the spindle 300 are thereby rotated. Further, the control unit 7 rotates the chuck table 5 by the table rotating mechanism 53 (see FIG. 2). Consequently, as illustrated in FIG. 12, the wafer 100 is rotated about the table rotational axis 501 as indicated by the arrow 502.

In this state, the control unit 7 lowers the finish grinding mechanism 31 along the Z-axis direction by the finish grinding feed mechanism 21. Thus, the control unit 7 lowers the rotating finish grinding stones 307 from above the holding surface 50 along a direction perpendicular to the holding surface 50, and thereby makes the rotating finish grinding stones 307 approach the wafer 100. Then, the control unit 7 brings the finish grinding stones 307 into contact with the back surface 103 of the wafer 100 held on the rotating chuck table 5, and thereby finish-grinds the back surface 103. Incidentally, FIG. 12 also illustrates the finished thickness T1 as a thickness of the wafer 100 after the finish grinding step.

Figure 12:
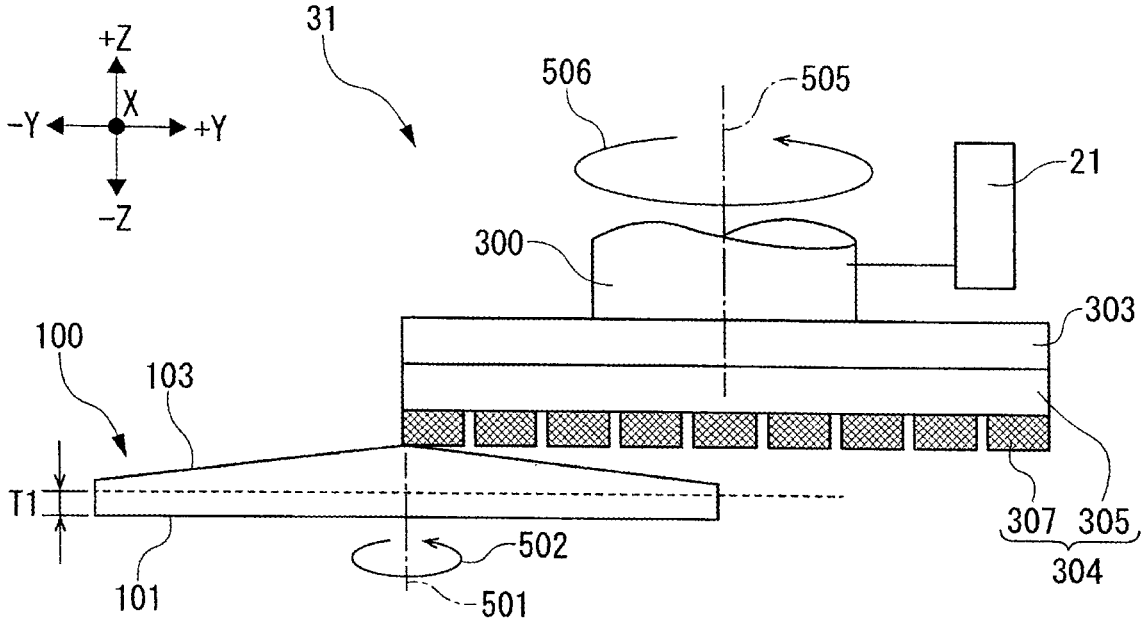
FIG. 12 is a diagram illustrating the finish grinding step for the centrally projecting shape wafer.

In this grinding, because the wafer 100 has a centrally projecting shape, as illustrated in FIG. 12, the finish grinding stones 307 first come into contact with the central part of the wafer 100, and grind the central part of the wafer 100. The central part of the wafer 100 thereby dresses the lower surfaces of the finish grinding stones 307.

Figure 13:
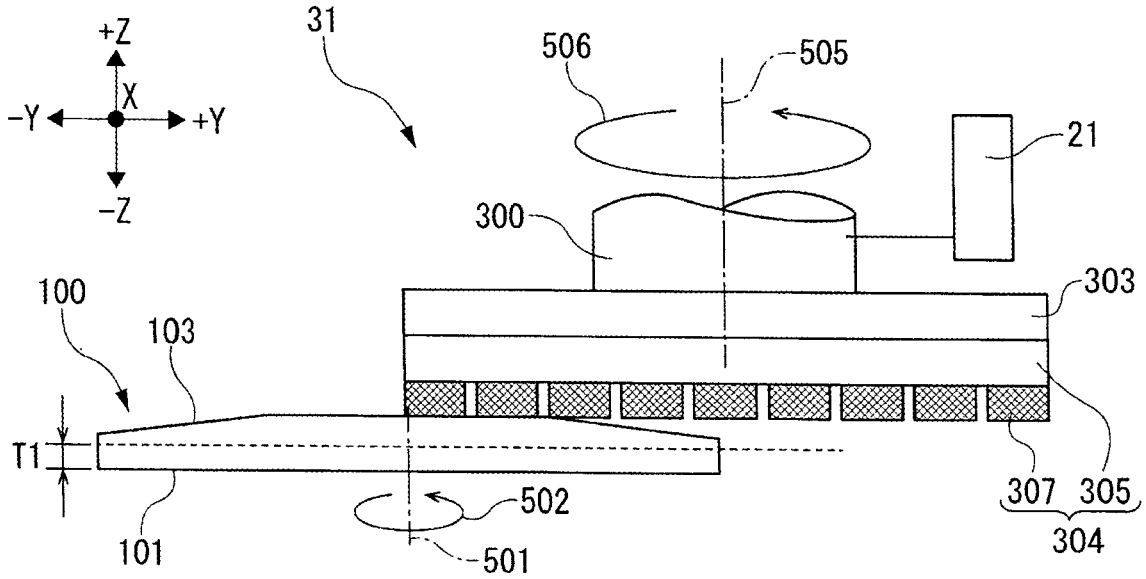
FIG. 13 is a diagram illustrating the finish grinding step for the centrally projecting shape wafer.

Thereafter, as the finish grinding mechanism 31 is lowered by the finish grinding feed mechanism 21, as illustrated in FIG. 13, the ground area of the wafer 100 (area of the ground area) expands from the central part to the peripheral part. The whole of the radius part of the wafer 100 (the whole of the back surface 103) thus becomes the ground area.

In addition, the control unit 7 measures the thickness of the wafer 100 by using the second height gauge 82. The control unit 7 performs the finish grinding until the thickness of the wafer 100 becomes the predetermined finished thickness T1. Consequently, as illustrated in FIG. 7, the wafer 100 having a uniform finished thickness T1 is obtained.

As described above, in the finish grinding step for the centrally projecting shape wafer 100, the ground area of the wafer 100 is expanded from the central part to the peripheral part while the central part of the wafer 100 dresses the lower surfaces of the finish grinding stones 307. Then, the whole of the radius part of the wafer 100 (the whole of the back surface 103) is set as the ground area, and further the wafer 100 is finish-ground so as to have the predetermined finished thickness T1.

Hence, even in a case where the finish grinding stones 307 are dulled, the finish grinding stones 307 can be dressed excellently by the central part of the hard wafer 100 at the beginning of the finish grinding of the wafer 100, so that the dulling can be resolved. Consequently, it becomes easy to grind the wafer 100 to a predetermined thickness. In addition, additional dressing of the finish grinding stones 307 does not need to be performed. It is therefore possible to suppress unnecessary wear in the finish grinding stones 307, and reduce grinding cost.

Incidentally, FIG. 5, FIG. 6, FIG. 12, and FIG. 13 do not illustrate that the wafer 100 is mounted on the conical holding surface 50 of the chuck table 5.

In addition, the angle of the chuck table 5 in the finish grinding step is, for example, an angle such that the lower surfaces of the finish grinding stones 307 and a part of the conical holding surface 50, which is located below the finish grinding stones 307, are parallel with each other (see FIG. 2).

In addition, the direction perpendicular to the holding surface 50 as a lowering direction of the finish grinding stones 307 in the finish grinding step is, for example, a direction perpendicular to the part of the conical holding surface 50 which is located below the finish grinding stones 307 (part parallel with the lower surfaces of the finish grinding stones 307).

However, the angle of the chuck table 5 in the finish grinding step is not limited to the above-described angle, but may be the same as or different from the angle of the chuck table 5 at the time of the rough grinding.

In addition, in the rough grinding step, the control unit 7 may rotate the chuck table 5 holding the wafer 100 by the holding surface 50, bring the rough grinding stones 306 into contact with the radius part of the wafer 100, and form the section along the diameter of the wafer 100 into a W-shape, that is, a shape in which a central part of the radius of the wafer 100 is thinner than the central part and the peripheral part of the wafer 100 by roughly grinding the wafer 100 such that the central part of the radius of the wafer 100 is thinnest. Incidentally, the central part of the radius in the wafer 100 is an intermediate part between the central part and the peripheral part of the wafer 100.

Figure 14:
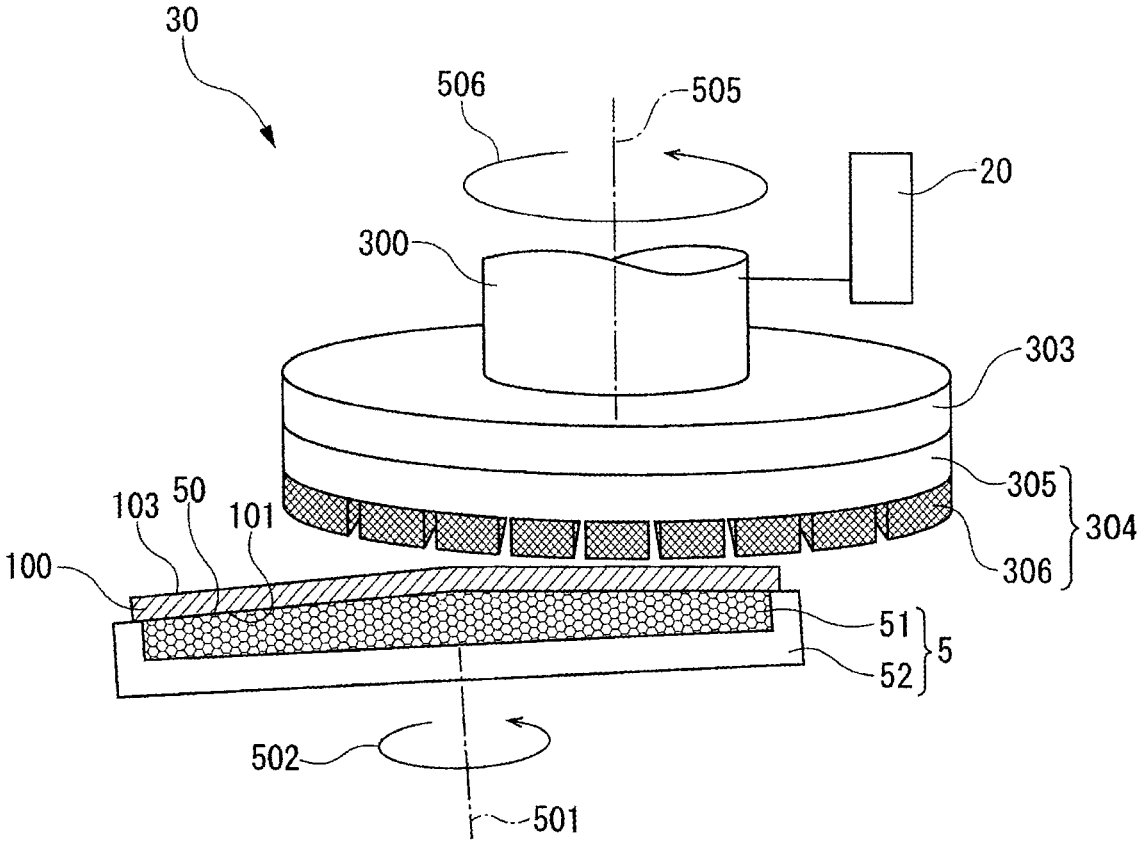
FIG. 14 is a diagram illustrating the inclination of the chuck table when a W-shaped wafer is formed.

Specifically, when the control unit 7 disposes the chuck table 5 holding the wafer 100 below the rough grinding mechanism 30 after the holding step, the control unit 7 controls the inclination adjusting mechanism 40 to adjust the inclination of the chuck table 5, and thereby adjusts the inclination of the holding surface 50 with respect to the lower surfaces of the rough grinding stones 306 such that the central part of the radius in the wafer 100 comes into contact with the rough grinding stones 306 first, as illustrated in FIG. 14.

Next, the control unit 7 rotationally drives the spindle 300 about the spindle rotational axis 505, as indicated by the arrow 506, by using the motor 302 (see FIG. 1) of the rough grinding mechanism 30. The rough grinding stones 306 attached to the lower end of the spindle 300 are thereby rotated. In this state, the control unit 7 lowers the rough grinding mechanism 30 along the Z-axis direction by the rough grinding feed mechanism 20. Further, the control unit 7 rotates the chuck table 5 about the table rotational axis 501 as indicated by the arrow 502 by the table rotating mechanism 53 (see FIG. 2). Consequently, the rotating rough grinding stones 306 come into contact with the back surface 103 of the wafer 100 held on the rotating chuck table 5, and roughly grind the back surface 103.

Figure 15:
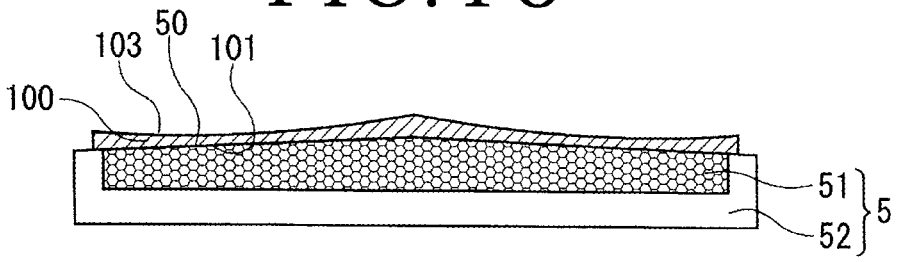
FIG. 15 is a diagram illustrating a section along the diameter of the wafer.

In this grinding, as illustrated in FIG. 14, the central part of the radius in the wafer 100 comes into contact with the rough grinding stones 306 first, that is, before the central side and the peripheral side of the wafer 100. Therefore, the grinding is started with the central part of the radius, and the back surface 103 of the wafer 100 is ground such that the ground region gradually expands to the central side and the peripheral side of the wafer 100. As a result, as illustrated in FIG. 15, the wafer 100 is ground such that the central part of the radius in the back surface 103 as a ground surface is thinner than the central part and the peripheral part of the wafer 100 and the section along the diameter of the wafer 100 becomes a W-shape. The wafer 100 thus becomes a W-shaped wafer 100.

Incidentally, the control unit 7 measures, for example, the thickness of the central part of the radius in the wafer 100 by using the first height gauge 81 in the rough grinding step, and performs the rough grinding until this thickness becomes a predetermined thickness. Incidentally, the measurement position of the first height gauge 81 is preferably set so as to measure a thinnest part of the wafer 100.

In addition, in the finish grinding step for the W-shaped wafer 100, the control unit 7 first disposes the chuck table 5 holding the W-shaped wafer 100 after being roughly ground by the holding surface 50 below the finish grinding mechanism 31 by rotating the turn table 6 illustrated in FIG. 1. Consequently, as illustrated in FIG. 16, the W-shaped wafer 100 is disposed below the finish grinding stones 307 in the finish grinding mechanism 31.

Next, the control unit 7 rotationally drives the spindle 300 about the spindle rotational axis 505, as indicated by the arrow 506, by driving the motor 302 (see FIG. 1) of the finish grinding mechanism 31. The finish grinding stones 307 attached to the lower end of the spindle 300 are thereby rotated. Further, the control unit 7 rotates the chuck table 5 by the table rotating mechanism 53 (see FIG. 2). Consequently, as illustrated in FIG. 16, the wafer 100 is rotated about the table rotational axis 501 as indicated by the arrow 502.

In this state, the control unit 7 lowers the finish grinding mechanism 31 along the Z-axis direction by the finish grinding feed mechanism 21. Thus, the control unit 7 lowers the rotating finish grinding stones 307 from above the holding surface 50 along a direction perpendicular to the holding surface 50, and thereby makes the rotating finish grinding stones 307 approach the wafer 100. Then, the control unit 7 brings the finish grinding stones 307 into contact with the back surface 103 of the wafer 100 held on the rotating chuck table 5, and thereby finish-grinds the back surface 103.

Figure 16:
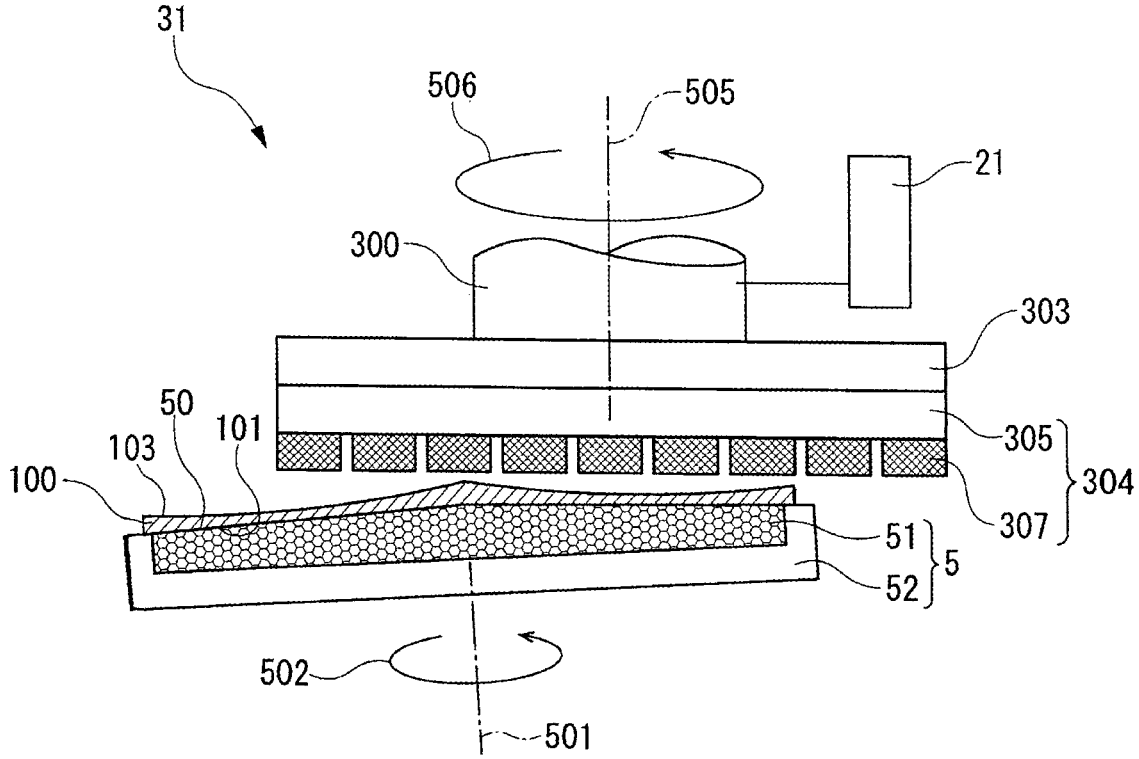
FIG. 16 is a diagram illustrating the finish grinding step for the W-shaped wafer.

In this grinding, because the wafer 100 has a W-shape, as illustrated in FIG. 16, the finish grinding stones 307 first come into contact with the central part and the peripheral part of the wafer 100, and grind the central part and the peripheral part of the wafer 100. The central part and the peripheral part of the wafer 100 thereby dress the lower surfaces of the finish grinding stones 307.

Thereafter, as the finish grinding mechanism 31 is lowered by the finish grinding feed mechanism 21, the ground area of the wafer 100 (area of the ground area) expands from the central part toward the peripheral part, and the ground area of the wafer 100 (area of the ground area) expands from the peripheral part toward the central part. The whole of the radius part of the wafer 100 (the whole of the back surface 103) thus becomes the ground area.

In addition, the control unit 7 measures the thickness of the wafer 100 by using the second height gauge 82. The control unit 7 performs the finish grinding until the thickness of the wafer 100 becomes the predetermined finished thickness T1 (see FIG. 7). Consequently, as illustrated in FIG. 7, the wafer 100 having a uniform finished thickness T1 is obtained.

As described above, in the finish grinding step for the W-shaped wafer 100, the ground area of the wafer 100 is expanded from the central part toward the peripheral part, and the ground area of the wafer 100 is expanded from the peripheral part toward the central part while the central part and the peripheral part of the wafer 100 dress the lower surfaces of the finish grinding stones 307. Then, the whole of the radius part of the wafer 100 (the whole of the back surface 103) is set as the ground area, and further the wafer 100 is finish-ground so as to have the predetermined finished thickness T1.

Hence, even in a case where the finish grinding stones 307 are dulled, the finish grinding stones 307 can be dressed excellently by the central part and the peripheral part of the hard wafer 100 at the beginning of the finish grinding of the wafer 100, so that the dulling can be resolved. Consequently, it becomes easy to grind the wafer 100 to a predetermined thickness. In addition, additional dressing of the finish grinding stones 307 does not need to be performed. It is therefore possible to suppress unnecessary wear in the finish grinding stones 307 and reduce grinding cost.

Incidentally, FIG. 14 and FIG. 16 illustrate the chuck table 5, the rough grinding mechanism 30, and the finish grinding mechanism 31 from directions different from those in FIG. 10 and FIG. 12 or the like. Also in the rough grinding step illustrated in FIG. 14 and the finish grinding step illustrated in FIG. 16, the rough grinding stones 306 and the finish grinding stones 307 are arranged so as to pass the center of the wafer 100.

In addition, in the present embodiment, when the wafer 100 is ground into a section of the centrally recessed shape, the centrally projecting shape, or the W-shape in the rough grinding step, the inclination of the chuck table 5 is adjusted by using the inclination adjusting mechanism 40 (see FIG. 2), and thereby the inclination of the holding surface 50 with respect to the lower surfaces of the rough grinding stones 306 is adjusted. In relation to this, when the wafer 100 is ground into a section of the centrally recessed shape, the centrally projecting shape, or the W-shape in the rough grinding step, the inclination of the spindle 300 in the rough grinding mechanism 30 may be adjusted by using an inclination adjusting mechanism, which is not illustrated but is provided to the rough grinding mechanism 30, in place of or in addition to adjusting the inclination of the chuck table 5. The inclination of the lower surfaces of the rough grinding stones 306 with respect to the holding surface 50 of the chuck table 5 may be thereby adjusted.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A hard wafer grinding method for grinding a radius part from a center to a periphery of a hard wafer held on a holding surface of a chuck table by lower surfaces of grinding stones arranged in an annular shape having a diameter larger than a radius of the hard wafer, the hard wafer grinding method comprising:

a rough grinding step of rotating the chuck table holding the hard wafer by the holding surface, bringing rough grinding stones arranged in an annular shape into contact with the radius part of the hard wafer, and forming a section along a diameter of the hard wafer into a centrally recessed shape by roughly grinding the hard wafer such that a central part of the hard wafer is thinner than a peripheral part of the hard wafer; and a finish grinding step of rotating the chuck table holding the hard wafer of the centrally recessed shape after the rough grinding by the holding surface, expanding a ground area of the hard wafer from the peripheral part in an annular shape to the central part while dressing, by the peripheral part of the hard wafer, lower surfaces of finish grinding stones capable of coming into contact with the radius part of the hard wafer and arranged in an annular shape by making the finish grinding stones approach the hard wafer from above the holding surface along a direction perpendicular to the holding surface, then setting a whole of the radius part of the hard wafer as the ground area, and further finish-grinding the hard wafer so as to obtain a predetermined thickness.

2. A hard wafer grinding method for grinding a radius part from a center to a periphery of a hard wafer held on a holding surface of a chuck table by lower surfaces of grinding stones arranged in an annular shape having a diameter larger than a radius of the hard wafer, the hard wafer grinding method comprising:

a rough grinding step of rotating the chuck table holding the hard wafer by the holding surface, bringing rough grinding stones arranged in an annular shape into contact with the radius part of the hard wafer, and forming a section along a diameter of the hard wafer into a centrally projecting shape by roughly grinding the hard wafer such that a peripheral part of the hard wafer is thinner than a central part of the hard wafer; and a finish grinding step of rotating the chuck table holding the hard wafer of the centrally projecting shape after the rough grinding by the holding surface, expanding a ground area of the hard wafer from the central part to the peripheral part while dressing, by the central part of the hard wafer, lower surfaces of finish grinding stones capable of coming into contact with the radius part of the hard wafer and arranged in an annular shape by making the finish grinding stones approach the hard wafer from above the holding surface along a direction perpendicular to the holding surface, then setting a whole of the radius part of the hard wafer as the ground area, and further finish-grinding the hard wafer so as to obtain a predetermined thickness.

3. A hard wafer grinding method for grinding a radius part from a center to a periphery of a hard wafer held on a holding surface of a chuck table by lower surfaces of grinding stones arranged in an annular shape having a diameter larger than a radius of the hard wafer, the hard wafer grinding method comprising:

a rough grinding step of rotating the chuck table holding the hard wafer by the holding surface, bringing rough grinding stones arranged in an annular shape into contact with the radius part of the hard wafer, and forming a section along a diameter of the hard wafer into a W-shape by roughly grinding the hard wafer such that an intermediate part between a central part and a peripheral part of the hard wafer is thinnest; and a finish grinding step of rotating the chuck table holding the hard wafer of the W-shape after the rough grinding by the holding surface, expanding a ground area of the hard wafer from the central part toward the peripheral part and expanding the ground area of the hard wafer from the peripheral part toward the central part while dressing, by the central part and the peripheral part of the hard wafer, lower surfaces of finish grinding stones capable of coming into contact with the radius part of the hard wafer and arranged in an annular shape by making the finish grinding stones approach the hard wafer from above the holding surface along a direction perpendicular to the holding surface, then setting a whole of the radius part of the hard wafer as the ground area, and further finish-grinding the hard wafer so as to obtain a predetermined thickness.

4. The hard wafer grinding method according to claim 1, wherein grinding stones of a grain size of #1000 to #1400 are used as the rough grinding stones, and grinding stones of a grain size of #1800 to #2400 are used as the finish grinding stones.

5. The hard wafer grinding method according to claim 2, wherein grinding stones of a grain size of #1000 to #1400 are used as the rough grinding stones, and grinding stones of a grain size of #1800 to #2400 are used as the finish grinding stones.

6. The hard wafer grinding method according to claim 3, wherein grinding stones of a grain size of #1000 to #1400 are used as the rough grinding stones, and grinding stones of a grain size of #1800 to #2400 are used as the finish grinding stones.

7. The hard wafer grinding method according to claim 3, wherein the hard wafer is a sapphire wafer.

8. The hard wafer grinding method according to claim 2, wherein the hard wafer is a sapphire wafer.

9. The hard wafer grinding method according to claim 1, wherein the hard wafer is a sapphire wafer.

* * * * *